US008302682B2

(12) United States Patent
McInally

(10) Patent No.: US 8,302,682 B2
(45) Date of Patent: Nov. 6, 2012

(54) WIRELINE TRACTOR DEVICE

(75) Inventor: Gerald McInally, Bryne (NO)

(73) Assignee: Aker Well Service AS, Stavanger (NO)

( * ) Notice: Subject to any disclaimer, the term of this patent is extended or adjusted under 35 U.S.C. 154(b) by 408 days.

(21) Appl. No.: 12/530,706

(22) PCT Filed: Feb. 29, 2008

(86) PCT No.: PCT/NO2008/000075

§ 371 (c)(1),
(2), (4) Date: Oct. 2, 2009

(87) PCT Pub. No.: WO2008/111844

PCT Pub. Date: Sep. 18, 2008

(65) Prior Publication Data

US 2010/0012315 A1 Jan. 21, 2010

(30) Foreign Application Priority Data

Mar. 13, 2007 (NO) ..... 20071358

(51) Int. Cl.
*E21B 23/14* (2006.01)
*E21B 4/18* (2006.01)

(52) U.S. Cl. ..... 166/241.5; 166/217; 175/94; 175/105; 175/106

(58) Field of Classification Search ..... 175/61, 175/94, 95, 104, 106; 166/206, 217, 241.5, 166/381

See application file for complete search history.

(56) References Cited

U.S. PATENT DOCUMENTS

| | | | | |
|---|---|---|---|---|
| 4,085,808 | A * | 4/1978 | Kling | 175/94 |
| 5,184,676 | A * | 2/1993 | Graham et al. | 166/66.4 |
| 5,375,668 | A * | 12/1994 | Hallundbaek | 175/53 |
| 6,179,055 | B1 * | 1/2001 | Sallwasser et al. | 166/254.2 |
| 6,273,189 | B1 * | 8/2001 | Gissler et al. | 166/241.1 |
| 6,454,011 | B1 | 9/2002 | Schempf et al. | |
| 2003/0146029 | A1 * | 8/2003 | Heinen | 180/65.5 |
| 2005/0145415 | A1 | 7/2005 | Doering et al. | |
| 2005/0217861 | A1 * | 10/2005 | Misselbrook | 166/373 |
| 2006/0042835 | A1 * | 3/2006 | Guerrero et al. | 175/61 |
| 2010/0012315 | A1 * | 1/2010 | McInally | 166/241.5 |

FOREIGN PATENT DOCUMENTS

WO 2006115418 11/2006

* cited by examiner

*Primary Examiner* — Jennifer H Gay

(74) *Attorney, Agent, or Firm* — Smith, Gambrell & Russell, LLP

(57) ABSTRACT

A wireline tractor includes a displacement mechanism and at least one driving wheel positioned on the displacement mechanism so that the driving wheel is held in a biasing manner against a well wall. The displacement mechanism is rotatable or movable between a first position at which the driving wheel bears against the well wall on one side of the wireline tractor, and a second position at which the driving wheel bears against the well wall on the opposite side of the wireline tractor.

5 Claims, 3 Drawing Sheets

II–II

II–II

I–I

WIRELINE TRACTOR DEVICE

BACKGROUND OF THE INVENTION

This invention relates to a wireline tractor. More particularly, it relates to a wireline tractor comprising at least one driving wheel positioned on a displacement mechanism connected to the wireline tractor, in which the displacement mechanism is arranged so as to hold the driving wheel in a biasing manner against a well wall. The displacement mechanism is at least rotatable or movable between a first position at which the driving wheel bears against the well wall on one side of the wireline tractor, and a second position at which the driving wheel bears against the well wall on the opposite side of the wireline tractor.

In this connection, wireline tractor implies a unit which, when provided with supplied or stored energy, is arranged so as to be able to move itself within an open or cased borehole.

Wireline tractors have assumed considerable application in, for example, outfitting and maintenance work in petroleum wells. Many wireline tractors are provided with driving wheels which are biased against the well wall, the driving wheels moving the wireline tractor down into the well. A connected cable or pipe is oftentimes used to pull out the wireline tractor from the well.

Each driving wheel may be positioned on a swivel arm rotatably connected to the wireline tractor, in which the swivel arm is provided with required driving elements for transmitting motive power from the wireline tractor and onto the respective driving wheel. By virtue of the driving wheel being connected to a free end portion of its respective swivel arm, the driving wheel is arranged so as to be able to accommodate relatively large variations in well diameter.

During some work operations it would prove advantageous if possible to change the direction of rotation of the driving wheels so as to be able to move the wireline tractor in the opposite direction.

Due to limited space, among other things, it has proven difficult to provide wireline tractors with reversible driving wheels.

SUMMARY OF THE INVENTION

The object of the invention is to remedy or to reduce at least one of the disadvantages of the prior art.

The object is achieved by virtue of features disclosed in the following description and in the subsequent claims.

A wireline tractor in accordance with the invention comprises at least one driving wheel positioned on a displacement mechanism connected to the wireline tractor, in which the displacement mechanism is arranged so as to hold the driving wheel in a biasing manner against a well wall, and wherein the displacement mechanism at least is rotatable or movable between a first position at which the driving wheel bears against the well wall on one side of the wireline tractor, and a second position at which the driving wheel bears against the well wall on the opposite side of the wireline tractor.

Typically, the displacement mechanism comprises at least one swivel arm rotatably connected to the wireline tractor, wherein at least one driving wheel is positioned on a free portion of the swivel arm.

When the swivel arm is in its first position, the driving wheel bears against the well wall on one side of the wireline tractor, whereby the well tractor is moved inwards within the well.

When the swivel arm is in its second position, the driving wheel bears against the well wall on the opposite side of the wireline tractor, whereby the wireline tractor is moved outwards within the well.

In alternative embodiments, the displacement mechanism may be comprised of e.g. several mutually articulated swivel arms or movable attachments.

The device according to the invention provides a simple and reliable solution to a long-felt problem.

BRIEF DESCRIPTION OF THE DRAWINGS

In the following, an example of a preferred embodiment is described and is depicted in the accompanying drawings, in which.

DETAILED DESCRIPTION OF THE INVENTION

Figure 1:
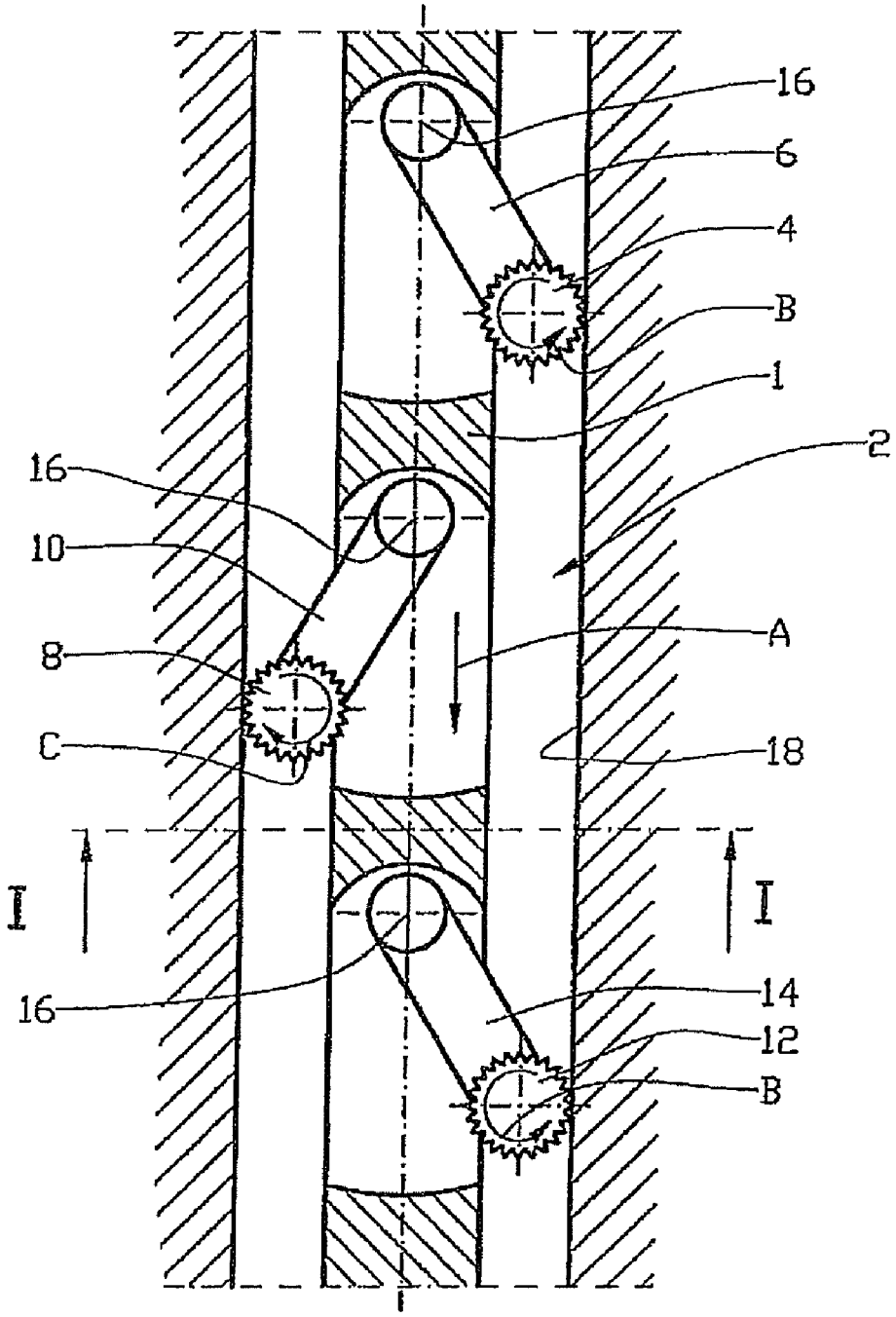
FIG. 1 schematically shows a longitudinal section II-II, see FIG. 2, through a portion of a wireline tractor, a well and a surrounding formation.
Figure 2:
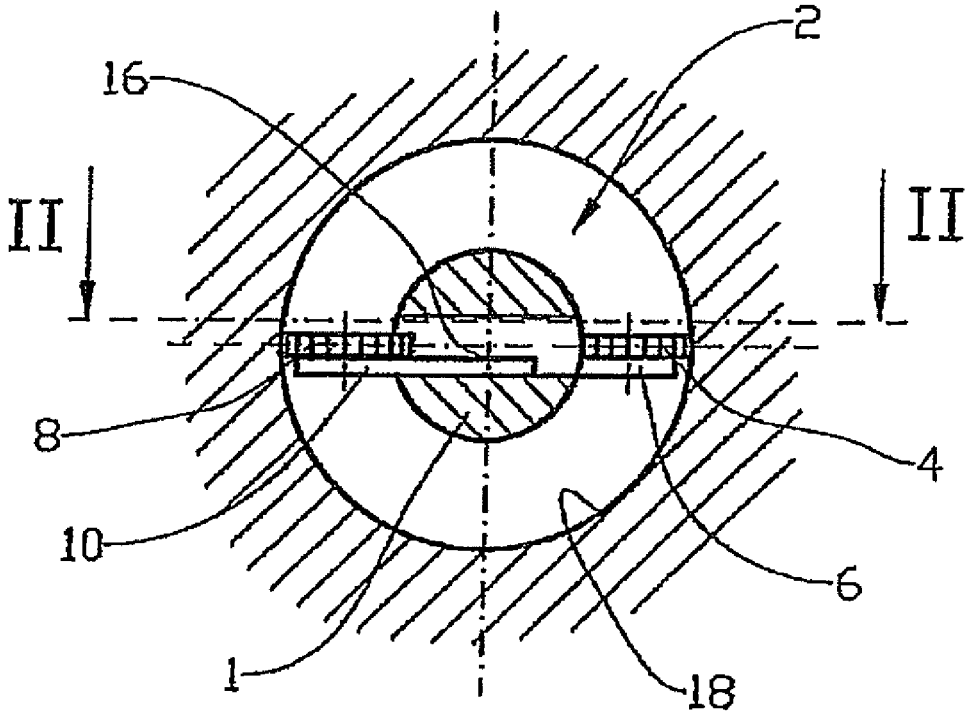
FIG. 2 schematically shows a section I-I of FIG. 1.

In the drawings, reference numeral 1 denotes a wireline tractor located in a well 2.

The wireline tractor 1 is provided with a first driving wheel 4 positioned on a free end portion of a first swivel arm 6, a second driving wheel 8 positioned on a free end portion of a second swivel arm 10, and a third driving wheel 12 positioned on a free end portion of a third swivel arm 14.

The swivel arms 6, 10 and 14 are rotatably connected to the wireline tractor 1 at their respective swivel joints 16, the swivel arms 6, 10 and 14 being provided with driving elements (not shown) for transmission of motive power from the wireline tractor 1 and onto the respective driving wheels 4, 8 and 12.

During movement of the wireline tractor 1 in the inward direction within the well, where the direction is indicated with an arrow A in FIG. 1, the first driving wheel 4 and the third driving wheel 12 rotate anticlockwise, as indicated with the arrows B in FIG. 1, and bear against the well wall 18 of the well 2 on one side of the wireline tractor 1.

Simultaneously, the second driving wheel 8 rotates clockwise, as indicated with the arrow C in FIG. 1, and bears against the well wall 18 on the opposite side of the wireline tractor 1.

Thus, the driving wheels 4, 8 and 12 of the wireline tractor 1 are biased against the well wall 18 and move the wireline tractor 1 inwards within the well 2 as they rotate.

Figure 3:
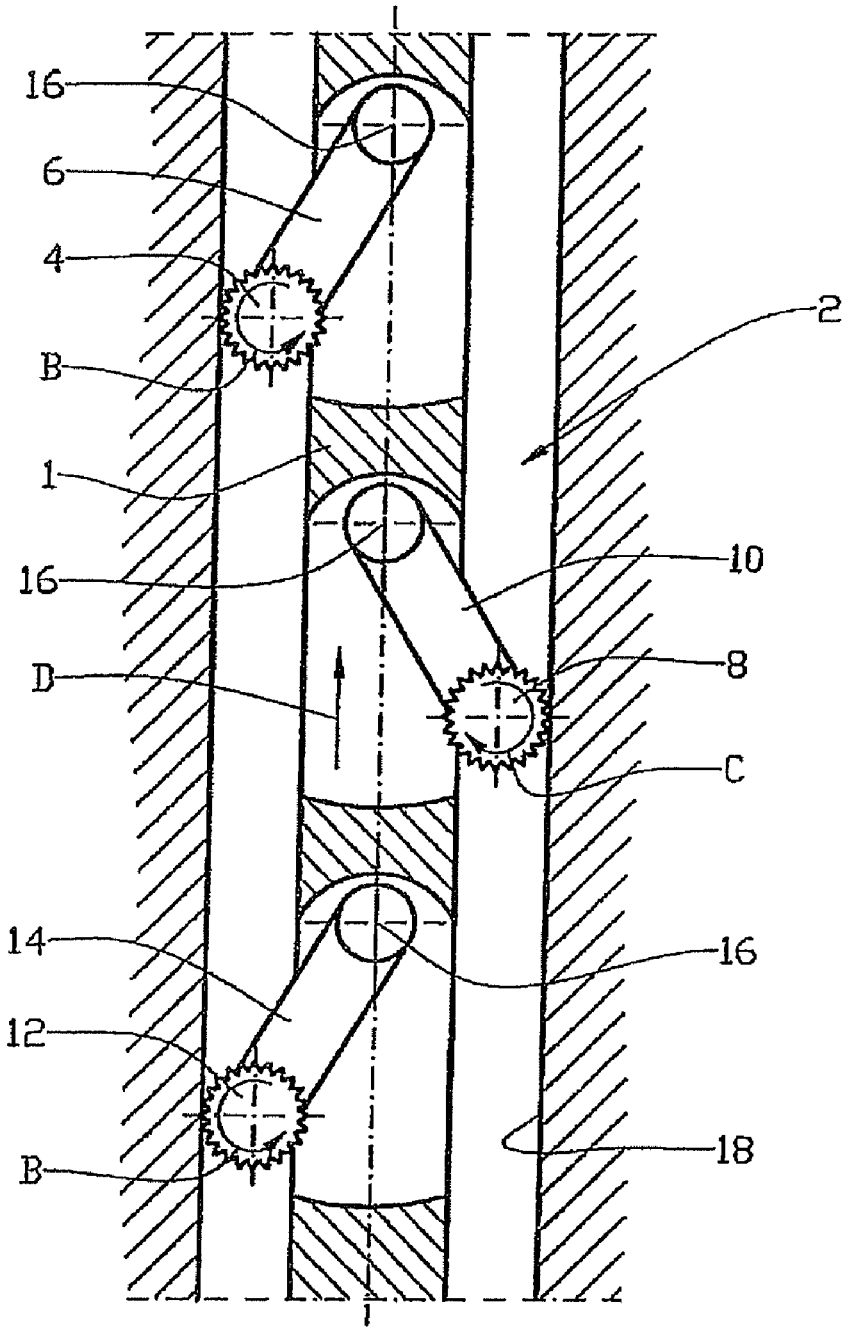
FIG. 3 schematically shows the same as that of FIG. 1, but wherein the swivel arms of the wireline tractor have been rotated into their respective second positions.

Upon moving the wireline tractor 1 outwards in the well 2 by means of the driving wheels 4, 8 and 12, as indicated by means of the arrow D in FIG. 3, the first swivel arm 6 and the third swivel arm 14 are rotated clockwise about their swivel joints 16 onto their respective second positions, whereas the second swivel arm 10 is rotated anticlockwise about its swivel joint 16 onto its second position. Then, each of the driving wheels 4, 8 and 12 is bears against the well wall 18 on the respective, opposite side of the wireline tractor 1, see FIG. 3.

The first driving wheel 4 and the third driving wheel 12 still rotate anticlockwise, whereas the second driving wheel 8 still rotates clockwise.

The moving direction of the wireline tractor 1 is thus is changed without changing the direction of rotation of the driving wheels 4, 8 and 12.

The invention claimed is:

1. A wireline tractor comprising:

a driving wheel and a displacement mechanism arranged so as to position and hold the driving wheel in a biasing manner against a well wall, wherein the displacement mechanism is rotatable or movable between a first position at which it causes the driving wheel to bear against the well wall on one side of the wireline tractor, and a second position at which it causes the driving wheel to bear against an opposite side of the well wall on the opposite side of the wireline tractor.

2. The wireline tractor in accordance with claim 1, wherein the displacement mechanism is comprised of at least one swivel arm, the swivel arm being rotatably connected to the wireline tractor.

3. The wireline tractor in accordance with claim 2, wherein the driving wheel is connected to a free end portion of the swivel arm.

4. The wireline tractor in accordance with claim 1, wherein the displacement mechanism is comprised of several mutually articulated swivel arms.

5. The wireline tractor in accordance with claim 1, wherein the displacement mechanism is comprised of a movable attachment.

* * * * *